US011122945B2

(12) United States Patent
Alsweis

(10) Patent No.: US 11,122,945 B2
(45) Date of Patent: Sep. 21, 2021

(54) TWO-IN-ONE UPRIGHT VACUUM

(71) Applicant: TRANSFORM SR BRANDS LLC, Hoffman Estates, IL (US)

(72) Inventor: Salameh Alsweis, Hoffman Estates, IL (US)

(73) Assignee: Transform SR Brands LLC, Hoffman Estates, IL (US)

( * ) Notice: Subject to any disclaimer, the term of this patent is extended or adjusted under 35 U.S.C. 154(b) by 289 days.

(21) Appl. No.: 16/209,669

(22) Filed: Dec. 4, 2018

(65) Prior Publication Data

US 2019/0167053 A1 Jun. 6, 2019

Related U.S. Application Data

(60) Provisional application No. 62/594,211, filed on Dec. 4, 2017.

(51) Int. Cl.

| | |
|---|---|
| ***A47L 9/02*** | (2006.01) |
| ***A47L 5/00*** | (2006.01) |
| ***A47L 9/28*** | (2006.01) |
| ***A47L 5/22*** | (2006.01) |
| ***A47L 5/30*** | (2006.01) |

(52) U.S. Cl.

CPC ..... *A47L 9/02* (2013.01); *A47L 5/00* (2013.01); *A47L 5/225* (2013.01); *A47L 5/30* (2013.01); *A47L 9/2842* (2013.01); *A47L 9/2873* (2013.01); *A47L 9/2878* (2013.01); *A47L 9/2884* (2013.01); *A47L 9/2894* (2013.01); *A47L 2201/00* (2013.01); *A47L 2201/022* (2013.01); *A47L 2201/024* (2013.01); *A47L 2201/06* (2013.01)

(58) Field of Classification Search

CPC ..... A47L 2201/00; A47L 2201/022; A47L 2201/024; A47L 2201/06; A47L 5/00; A47L 5/225; A47L 5/30; A47L 9/02; A47L 9/2842; A47L 9/2873; A47L 9/2878; A47L 9/2884; A47L 9/2894

See application file for complete search history.

(56) References Cited

U.S. PATENT DOCUMENTS 6,094,775 A * 8/2000 Behmer ..... A47L 5/225 15/329
7,113,847 B2 * 9/2006 Chmura ..... A47L 5/36 318/568.1

(Continued)

FOREIGN PATENT DOCUMENTS

DE 102010016263 A1 * 10/2011 ..... A47L 9/106
DE 102011054162 A1 * 4/2013 ..... A47L 9/149
KR 20120090707 A * 8/2012

OTHER PUBLICATIONS

KR20120090707A—English Machine Translation (Year: 2012).*

*Primary Examiner* — Marc Carlson
(74) *Attorney, Agent, or Firm* — McAndrews, Held & Malloy, Ltd.

(57) ABSTRACT

Systems and methods for providing a two-in-one vacuum cleaner are disclosed. In an exemplary embodiment, the system comprises a nozzle that is detachable from a rest of a vacuum cleaner. The nozzle is configured to perform as a vacuum nozzle of the vacuum cleaner when attached to the vacuum cleaner. The nozzle is also configured to perform as a robotic vacuum cleaner when detached from the vacuum cleaner.

14 Claims, 2 Drawing Sheets

(56) References Cited

U.S. PATENT DOCUMENTS

| | | | | |
|---|---|---|---|---|
| 7,412,748 | B2 * | 8/2008 | Lee | A47L 5/225 15/319 |
| 7,779,504 | B2 * | 8/2010 | Lee | A47L 9/106 15/319 |
| 7,837,958 | B2 * | 11/2010 | Crapser | A61L 9/122 422/291 |
| 9,462,920 | B1 * | 10/2016 | Morin | A47L 9/2842 |
| 2007/0006404 | A1 * | 1/2007 | Cheng | A47L 11/33 15/52.1 |
| 2007/0130717 | A1 * | 6/2007 | Yan | A47L 5/225 15/319 |
| 2007/0157416 | A1 * | 7/2007 | Lee | A47L 9/2894 15/319 |
| 2018/0303303 | A1 * | 10/2018 | Nyberg | H02J 50/10 |

* cited by examiner

TWO-IN-ONE UPRIGHT VACUUM

RELATED APPLICATIONS/INCORPORATION BY REFERENCE

The present application claims benefit from and priority to U.S. Application No. 62/594,211, filed Dec. 4, 2017. The above-identified application is hereby incorporated herein by reference in its entirety.

FIELD OF THE DISCLOSURE

Certain embodiments of the disclosure relate to systems and methods for providing a two-in-one upright vacuum system.

BACKGROUND OF THE DISCLOSURE

Conventional robotic vacuum cleaners lack power to provide a deep clean. However, conventional upright vacuum cleaners need to be manually pushed around do not provide robotic vacuum cleaning.

Further limitations and disadvantages of conventional and traditional approaches will become apparent to one of skill in the art, through comparison of such systems with the present disclosure as set forth in the remainder of the present application with reference to the drawings.

BRIEF SUMMARY OF THE DISCLOSURE

Systems, devices, and methods for providing a two-in-one upright vacuum system are provided substantially as illustrated by and/or described in connection with at least one of the figures, as set forth more completely in the claims.

Various advantages, aspects and novel features of the present disclosure, as well as details of an illustrated embodiment thereof, will be more fully understood from the following description and drawings.

DETAILED DESCRIPTION OF THE DISCLOSURE

As utilized herein the terms "circuit" and "circuitry" refer to physical electronic components (i.e., hardware) and any software and/or firmware ("code") which may configure the hardware, be executed by the hardware, and/or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations.

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated.

Some embodiments of the present disclosure relate to systems, methods, and devices for providing a two-in-one upright vacuum system.

Figure 1:
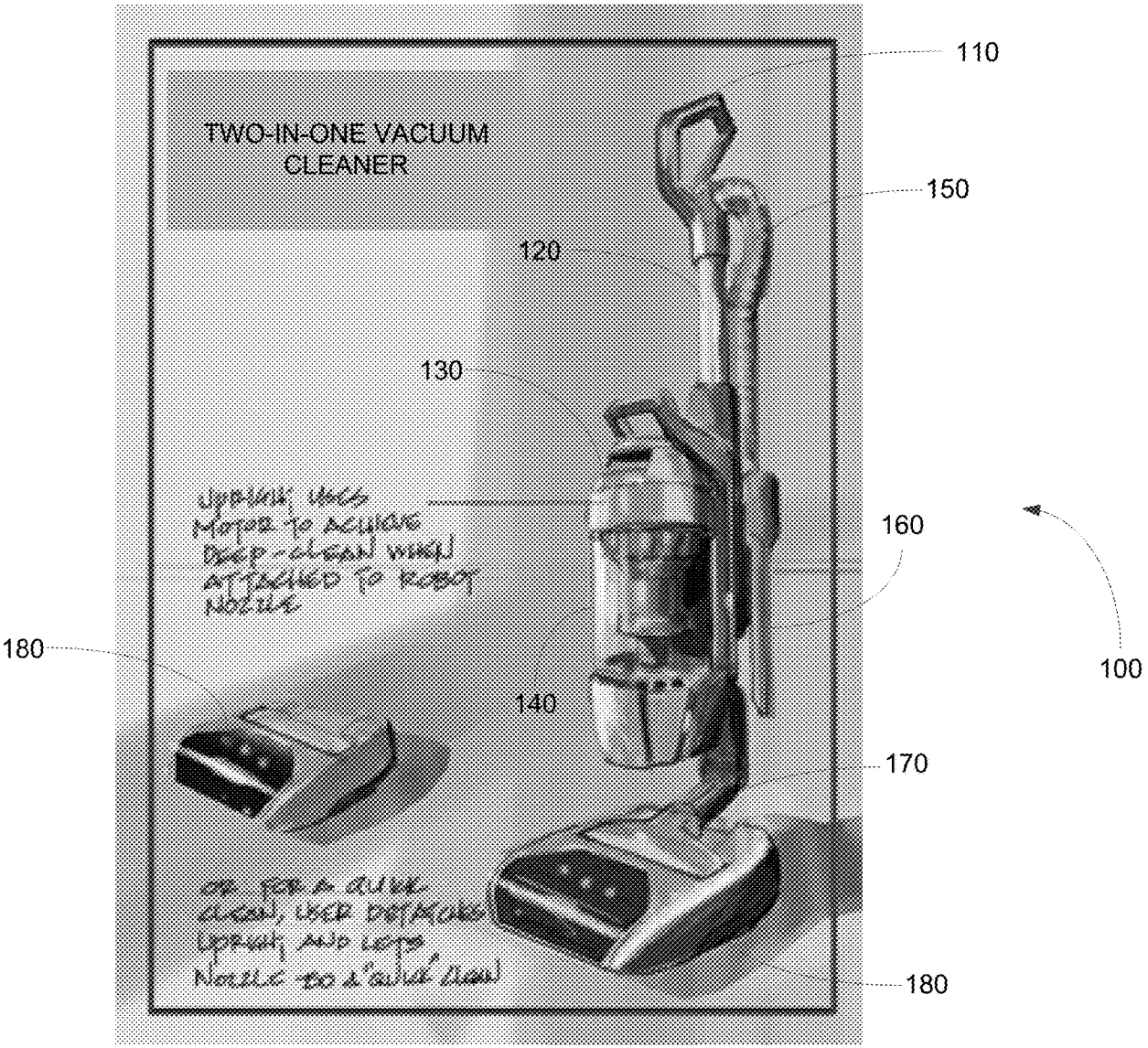
FIG. 1 shows an embodiment of a vacuum cleaner according to the present disclosure.
Figure 2:
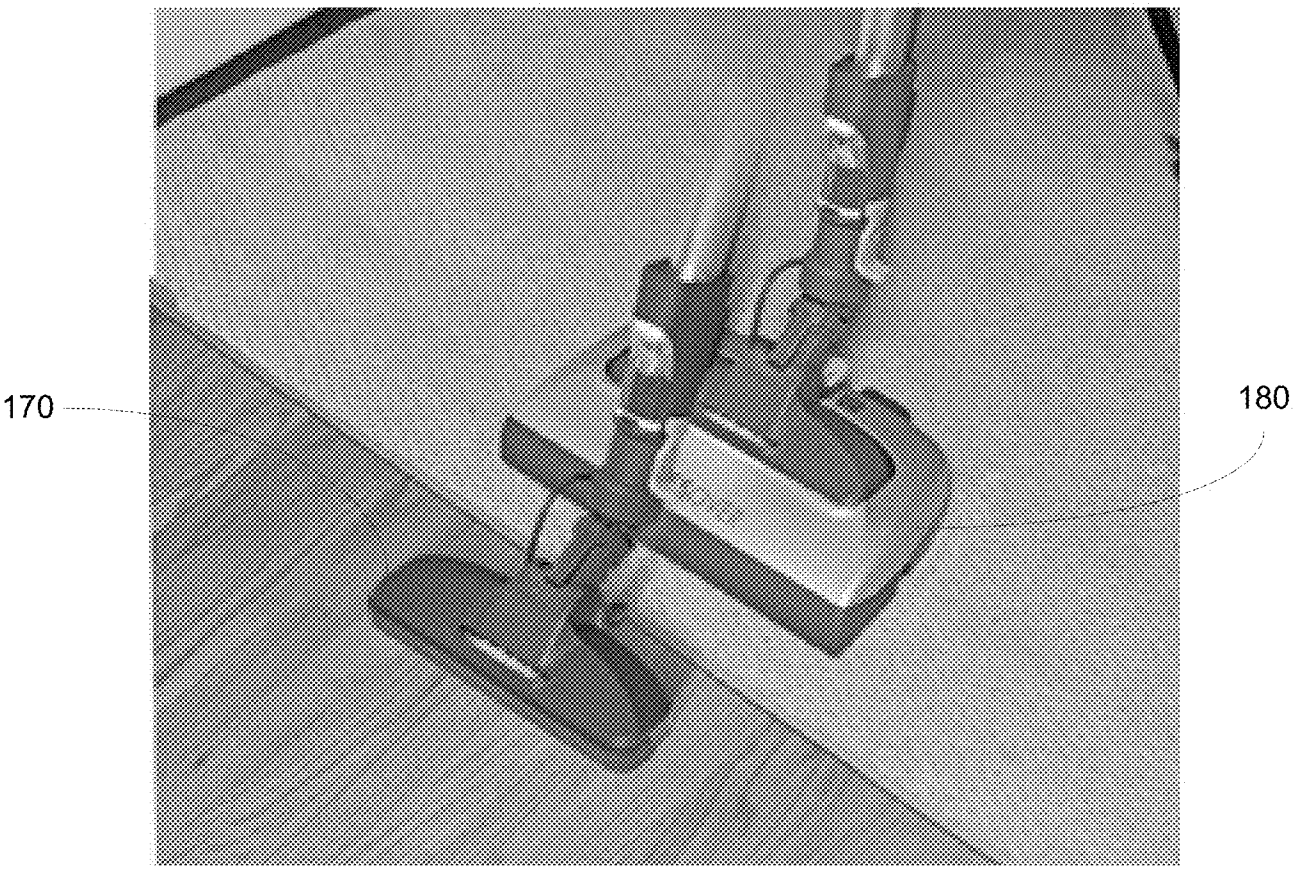
FIG. 2 shows an embodiment of the vacuum cleaner according to the present disclosure.

FIG. 1 shows an embodiment of a vacuum cleaner 100 (e.g., an upright vacuum cleaner) according to the present disclosure. Referring to FIG. 1, the vacuum cleaner 100 can include, for example, a handle 110, a wand 120, a motor 130, a dust bin 140, a hose 150, one or more accessories 160, a nozzle 170, and a robotic nozzle 180. Referring to FIG. 2, an embodiment of the nozzle 170 and the robotic nozzle 180 is shown. The robotic nozzle 180 can house its own motor that operates separately or in combination with the motor 130.

Referring to FIG. 1, the handle 110 is attached to the wand 120. The wand 130 is connected to the hose 150. The hose 150 and/or the wand 120 can be connected to the robotic nozzle 180 via the nozzle 170 to provide suction. The hose 150 can be disconnected at one end and coupled to the one or more accessories 160 to provide suction to the one or more accessories 160. The motor 130 is configured to provide the main suction power used by the vacuum cleaner 100 and is operatively coupled to the hose 150 via the wand 120, for example. In some embodiments, the motor 130 is operatively coupled to the robotic nozzle 180 via the nozzle 170 and/or a lower portion of the wand 120. The dust bin 140 is connected to the robotic nozzle 180 via the via the nozzle 170, the wand 120, and/or the hose 150.

In operation, the user can operate the vacuum cleaner 100 as an upright vacuum cleaner. The robotic nozzle 180 is used by the upright vacuum cleaner 100 as the main nozzle of the upright vacuum cleaner 100 when the operator manually cleans a floor in a room. Since the upright vacuum cleaner is using the motor 130, which is more powerful than the motor of the robotic nozzle 180, for its suction power, the upright vacuum cleaner 100 provides a deep and thorough cleaning of the floor (e.g., hardwood floor, carpeted floor, etc.). Dirt and/or dust particles can be sucked in through the robotic nozzle 180 and are filtered into the dust bin 140. Thus, according to some embodiments, although the robotic nozzle 180, which is attached to the rest of the vacuum cleaner 100, is being used to vacuum the floor, for example, the robotic nozzle 180 is not using its own motor 130 to generate suction, but is instead relying on the more powerful motor 130 of the vacuum cleaner 100.

Some embodiments provide that one or both of the motor of the robotic nozzle and the motor 130 of the upright vacuum cleaner 100 generate suction when the robotic nozzle 180 is attached to the rest of the vacuum cleaner 100. Some embodiments provide that, even when attached to the vacuum cleaner 100, the robotic nozzle 180 can use one or both of its own motor and the motor 130 of the vacuum cleaner to assist the operator to move the vacuum cleaner 100. Since the robotic nozzle 180 is configured so that it can move on its own, the robotic nozzle 180 can also be configured to assist the operator move the vacuum cleaner 100 forward or backward, for example, during cleaning and/or transport. The robotic nozzle 180 can include, for example, sensors that can sense motion, changes in motion, objects, walls, etc. The robotic nozzle 180 can amplify the forward or backward motion of vacuum cleaner 100 that is being manually provided by the operator during cleaning and/or transport. The robotic nozzle 180 can also reduce or diminish the forward or backward motion of the vacuum cleaner 100 that is being manually provided by the operator when the operator is changing directions, slowing down, stopping, and/or nearing a wall or furniture, for example.

The user can detach the robotic nozzle 180 from the rest of the upright vacuum cleaner 100. FIG. 2 shows, for example, how the upright vacuum cleaner 100 can be detached at the nozzle 170 from the robotic nozzle 180. By a press of a button or by other releasing mechanisms, the robotic nozzle 180 is detached from the rest of the upright vacuum cleaner 100 and operates as a robotic cleaner (e.g., a robotic vacuum cleaner, a robotic sweeper, etc.). The robotic nozzle 180 has its own motor that is not as powerful as the motor 130 of the upright vacuum cleaner 100. The motor of the robotic nozzle 180 powers not only the cleaning mechanism of the robotic nozzle 180 (e.g., suction, agitator brushes, etc.), but also powers the automated movement of the robotic nozzle 180. The robotic nozzle 180 also has one or more batteries or battery packs that are used to power the robotic nozzle 180 when it is detached from the upright vacuum cleaner 100. The one or more batteries or battery packs can be recharged when the robotic nozzle 180 is attached to the upright vacuum cleaner 100 and the upright vacuum cleaner 100 is plugged into a power source (e.g., a wall outlet or some other power supply or source). The one or more batteries or battery packs can also be removed from the robotic nozzle 180 and recharged in a separate charger. In comparison with the upright vacuum cleaner 100, the robotic nozzle 180 provides a quick clean.

In one example, the user may start vacuuming with the upright vacuum cleaner 100 and then, because the user must attend to other activities (e.g., answer a phone, attend to an appointment, etc.) might finish cleaning the floor by releasing the robotic nozzle 180. In some embodiments, the user can then place the rest of the upright vacuum cleaner 100 on a hook or mount, while the upright vacuum cleaner 100 is plugged into a wall outlet. On the hook or mount, the upright vacuum cleaner 100 can act as a charging station for the robotic nozzle 180. In some embodiments, the robotic nozzle 180 can be programmed, for example, to return to the charging station and to reattach to the upright vacuum cleaner 100. In some embodiments, when the robotic nozzle 180 is finished cleaning the floor, an internal dust bin of the robotic nozzle 180 is full, and/or the robotic nozzle 180 runs out of energy, the robotic nozzle 180 can automatically reattach to the rest of the upright vacuum cleaner 100 so that the robotic nozzle 180 can charge its battery. Further, once attached to the robotic nozzle 180, the upright vacuum cleaner 100 can automatically empty the dust bin of the robotic nozzle 180. For example, the motor 130 of the upright vacuum cleaner 100 can suck the dirt and/or dust in the dust bin of the robotic nozzle 180 into the dust bin 140 of the upright vacuum cleaner 100. Once the dust bin of the robotic nozzle 180 has been emptied and/or the battery for the robotic nozzle 180 has been sufficiently recharged, the robotic nozzle 180 can automatically detach from the upright vacuum cleaner 100 and finish cleaning the floor.

The robotic nozzle 180 can also be operated remotely by the user. Thus, for example, the user may use a wireless device such as a remote control, a key fob, a smartphone, a wireless communication device, a wireless computing tablet, a wireless mobile device, a laptop computer, a computer, etc. to control the robotic nozzle 180. The robotic nozzle 180 can be connected, for example, to an access point, a base station, a wireless local area network, a personal area network, a cellular network, a cloud, or some other network through which the user can control (e.g., program, instruct, command, operate, etc.) the robotic nozzle 180. Thus, for example, the user can send the robotic nozzle 180 on various cleaning missions around the house.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A system, comprising:

a nozzle that is detachable from a rest of a vacuum cleaner, wherein:

the nozzle is configured to perform as a vacuum nozzle of the vacuum cleaner when attached to the vacuum cleaner, the rest of the vacuum cleaner is not in contact with a surface to be vacuumed when the nozzle is attached to the vacuum cleaner, the nozzle is configured to perform as a robotic vacuum cleaner when detached from the vacuum cleaner, and the rest of the vacuum cleaner is operable to vacuum when the nozzle is detached from the vacuum cleaner.

2. The system according to claim 1, wherein the nozzle is configured to suck particles based on a first motor of the vacuum cleaner when the nozzle is attached to the vacuum cleaner.

3. The system according to claim 2, wherein the nozzle is configured to suck particles based on a second motor of the nozzle when the nozzle is detached from the vacuum cleaner.

4. The system according to claim 1, wherein the nozzle includes a battery that is recharged when the nozzle is attached to the vacuum cleaner.

5. The system according to claim 1, wherein contents of a dust bin of the nozzle are emptied into a dust bin of the vacuum cleaner when the nozzle is attached to the vacuum cleaner.

6. The system according to claim 1, wherein the nozzle acting as the robotic vacuum cleaner is controlled wirelessly by a wireless device.

7. The system according to claim 1, wherein the vacuum cleaner performs as an upright vacuum cleaner when the nozzle is attached to the vacuum cleaner.

8. A vacuum cleaner, comprising:

a motor operatively coupled to a robotic vacuum cleaner when the robotic vacuum cleaner is attached to the vacuum cleaner, wherein:

the vacuum cleaner is configured to perform as an upright vacuum cleaner when the robotic vacuum cleaner is attached, the robotic vacuum cleaner is configured to perform as a nozzle for the upright vacuum cleaner, the vacuum cleaner is not in contact with a surface to be vacuumed when the robotic vacuum cleaner is attached to the vacuum cleaner, and the vacuum cleaner is configured to perform as an unassisted upright vacuum cleaner when the robotic vacuum cleaner is detached.

9. The vacuum cleaner according to claim 8, wherein the robotic vacuum cleaner is configured to suck particles based on the motor of the vacuum cleaner when the nozzle is attached to the vacuum cleaner.

10. The vacuum cleaner according to claim 9, wherein the robotic vacuum cleaner is configured to suck particles based on a second motor of the robotic vacuum cleaner when the robotic vacuum cleaner is detached from the vacuum cleaner.

11. The vacuum cleaner according to claim 8, wherein the robotic vacuum cleaner includes a battery that is recharged when the robotic vacuum cleaner is attached to the vacuum cleaner.

12. The vacuum cleaner according to claim 8, wherein contents of a dust bin of the robotic vacuum cleaner are emptied into a dust bin of the vacuum cleaner when the robotic vacuum cleaner is attached to the vacuum cleaner.

13. The vacuum cleaner according to claim 8, wherein the robotic vacuum cleaner is configured to be controlled wirelessly.

14. The vacuum cleaner according to claim 8, wherein the robotic vacuum cleaner is configured to be controlled wirelessly by a smartphone or a wireless communication device.

* * * * *